United States Patent [19]

Bottaro

[11] 3,977,359

[45] Aug. 31, 1976

[54] COMPOSITE AIR-KNIFE

[75] Inventor: Franco Bottaro, Genoa, Italy

[73] Assignee: Italsider S.p.A., Italy

[22] Filed: July 29, 1975

[21] Appl. No.: 600,128

[30] Foreign Application Priority Data

Aug. 8, 1974 Italy ..... 12925/74

[52] U.S. Cl. ..... 118/63; 15/307; 15/418

[51] Int. Cl.[2] ..... B05C 11/06

[58] Field of Search ..... 118/63, 69, 58; 427/348, 349; 34/1 NQ; 239/1 NQ; 15/415–418, 405, 316–318, 307

[56] References Cited

UNITED STATES PATENTS

| | | | |
|---|---|---|---|
| 3,314,163 | 4/1967 | Kohler | 118/63 X |
| 3,499,418 | 3/1970 | Mayhew | 118/63 X |
| 3,526,204 | 9/1970 | Schnedler et al. | 118/63 X |
| 3,687,103 | 8/1972 | La Camera et al. | 118/63 |

*Primary Examiner*—Morris Kaplan
*Attorney, Agent, or Firm*—Robert E. Burns; Emmanuel J. Lobato; Bruce L. Adams

[57] ABSTRACT

In a coating apparatus, doctor means for effecting a uniform coating of a molten metal includes an air-knife means having a sliding shutter disposed within the nozzle at each end of the slot thereof. Each shutter is configurated and operatively associated with a nozzle wall to form a chamber having an opening at the nozzle slot. Means feed a gaseous fluid through each said chamber at a relatively high pressure to therby effect a composite air-knife having higher pressures at the ends thereof.

3 Claims, 5 Drawing Figures

COMPOSITE AIR-KNIFE

BACKGROUND OF THE INVENTION

It is well known how to coat a metal strip, particularly a steel strip, with a layer of protecting metal, e.g. zinc, by making said metal strip pass through a bath of molten zinc.

In order to obtain the most uniform possible coating layer, it is further known to blow, onto both surfaces of the metal strip coming out of the bath, a jet of steam or gas under pressure (generally air) through a long and thin nozzle whose length is at least as the strip width.

It is also known that when said nozzle has a constant thickness, the gas or steam pressure at both ends of the nozzle decreases and has the behaviour shown in FIG. 1, wherein the ordinates denote the pressure (p) and the abscissaes the nozzle length (L).

It is further known that when said strip comes out of the molten zinc tank, the coating metal tends to deposit more on the strip edges than on the central area thereof, as in said two zones of the strip the cooling is quicker.

In order to remove the first mentioned inconvenience (decrease in the jet pressure from the centre towards the ends of the nozzle), a known nozzle was used having a larger width at its ends than at its center, in such a way, being the delivery of the nozzle higher at its two ends, is counterbalanced the pressure decrease shown in FIG. 1. A device suitable to embody effectively said characteristic is for instance claimed by the Italian Patent No. 896,562 of the same applicants.

Further, according to a subsequent patent still of the same applicant, two shutters were provided at the two ends of said elongated nozzle, said shutters defining exactly the width of the steam or gas blade according to the width of the metal strip to be coated. In this way, the mutual strike of the two opposed jets in the areas just adjacent the strip edges is avoided, improving so the critical conditions of pressure.

Said shutters have also the task of removing the noise caused by the strike of said opposed jets against each other. The distribution of the pressure along the nozzle after using said shutters is shown in FIG. 2, wherein the abscissaes denote the nozzle length (L) and the ordinates the pressure (p) along same.

When comparing said FIGS. 1 and 2, the advantages obtained by using the improvements shown in said two patents of the same applicants appear clearly.

However, it was noted that even by using a pressure diagram of the type shown in FIG. 2, it is not possible to remove the inconvenience of a larger thickness of the coating layer at the two side ends of the metal strip; such an inconvenience, as said above, depends on the higher cooling speed of the coating metal at the edges of the metal strip.

OBJECT OF THE INVENTION

In view of the foregoing, the invention aims at removing said inconvenience through an improved device suitable to blow an air blade onto a metal strip coated by a layer of molten metal.

SUMMARY OF THE INVENTION

The improved device for blowing an air blade, that is a thin and elongated jet of gas under pressure, against a metal strip in motion coated by a layer of liquid material, particularly against a metal strip coated by a layer of molten zinc, of the type comprising an elongated nozzle consisting of two lips inclined with respect to each other for an angle between 30° and 80°, the first of which being substantially perpendicular to the coated strip, wherein the nozzle length, measured parallel to said two lips, is variable by means of a pair of sliding shutters whose transversal profile matches the inner profile of the nozzle cross section, comprises an ejector fed with gas or steam at a pressure higher than that feeding the elongated nozzle, provided at the inner end of each of said shutters.

Said ejector consists of a chamber sliding together with the associated shutter within the nozzle manifold, said chamber being provided with an outlet directed against said nozzle and fed through a conduit for pressure fluid.

Said chamber is resting against the inner surfaces of the two lips of the nozzle and is guided at the rear by a groove provided in the thickness of the manifold of said elongated nozzle.

Said ejector is provided with a feeding conduit having a section elongated parallel to the direction of the nozzle lips.

The ejector feeding conduit opens into a sliding sleeve which slides within a secondary conduit parallel to the nozzle lips, provided at its bottom with a groove for the passage of the ejector feeding conduit; said secondary conduit being stationary with respect to the elongated nozzle manifold and provided on its turn with means for feeding the pressure fluid, said means passing through the wall of the elongated nozzle manifold.

BRIEF DESCRIPTION OF THE DRAWINGS

In order that the invention may be clearly understood, it will now be described, by way of example, with reference to the accompanying drawings, wherein.

DESCRIPTION OF THE PREFERRED EMBODIMENTS

Figures 1, 4:
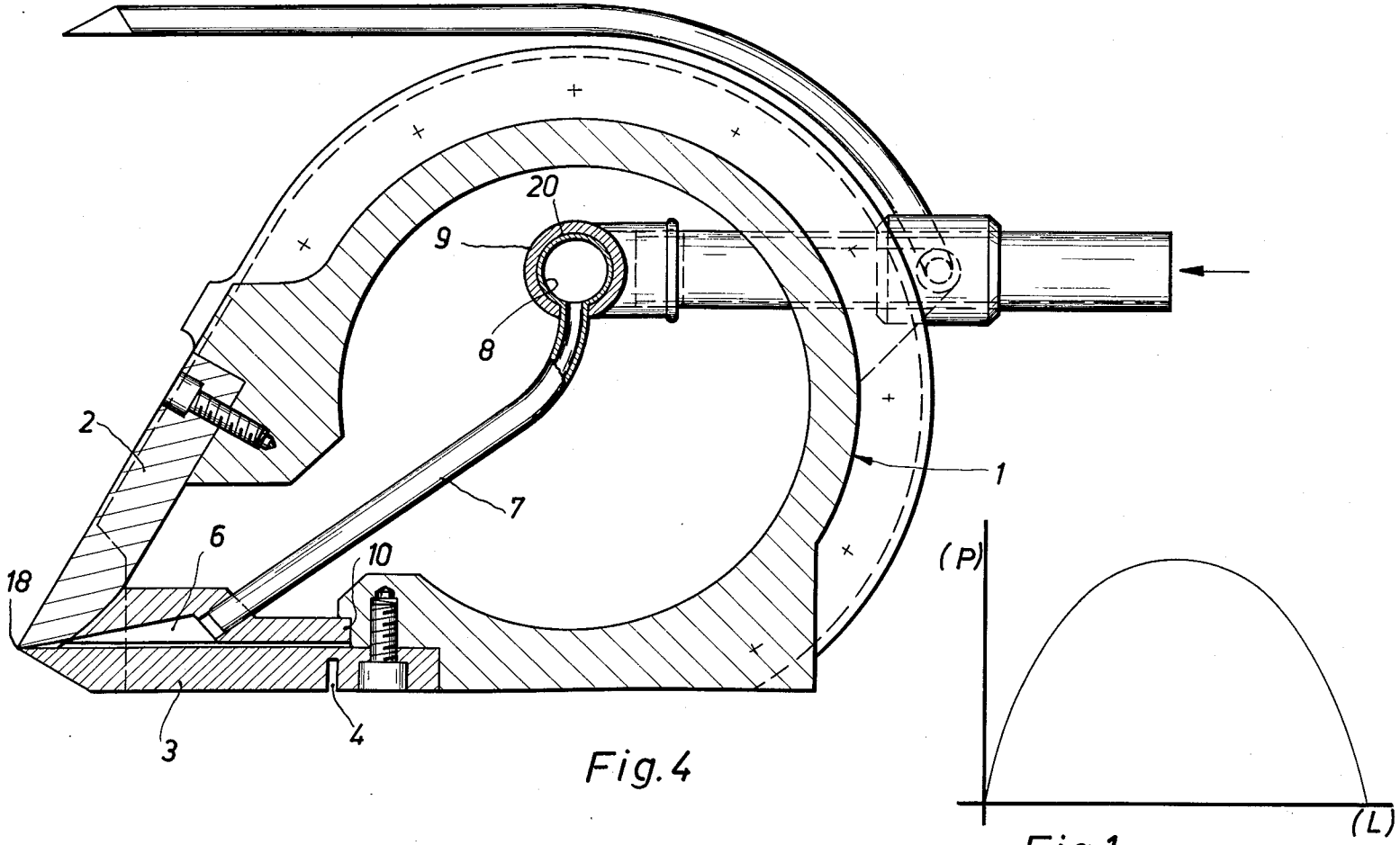
FIGS. 1 and 2 show the behaviour of the pressure along the nozzle of the type described, when the nozzle width is kept constant and when the nozzle is provided with the improvements according to the applicants' two previous patents respectively.
FIG. 4 is a cross section of the nozzle end according to the invention.
Figure 2:
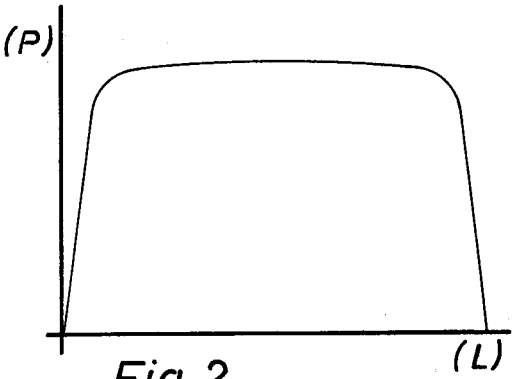

FIG. 4 shows a substantially cylindrical manifold 1, fed with gas and/or steam under pressure (usually air under pressure), through feeding conduits not shown. Said manifold 1 has two elongated lips 2 and 3 the first of which is stiff, while the second one, thanks to slot 4, is resilient and, through suitable drawing and compression means not shown, is in position to embody a nozzle whose outlet port has a variable width.

According to the present invention, (FIGS. 4 and 5) shutters 5 are arranged at both ends of said manifold 1, said shutters obstructing at least partly the nozzle created by the lips 2, 3.

Figure 5:
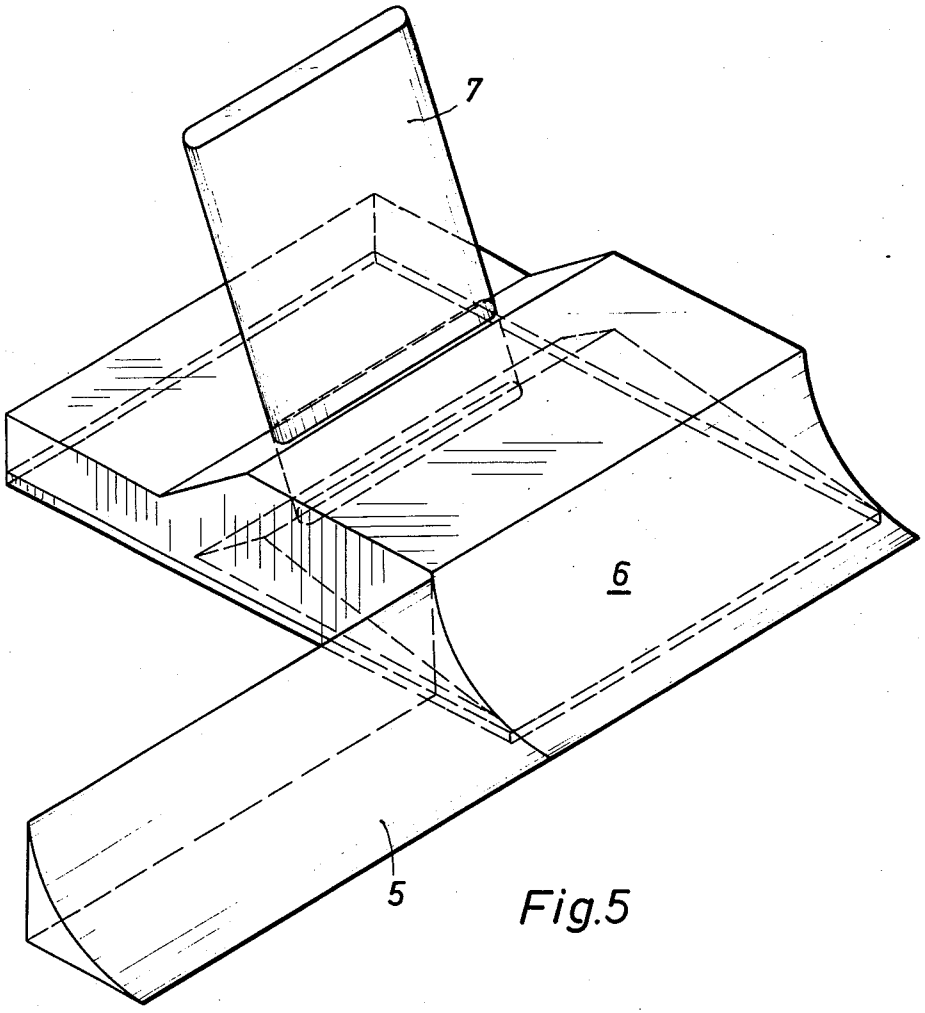
FIG. 5 is a perspective view of an improved shutter according to the invention, of the type shown in FIG. 4.

Each of said shutters 5 ends inside, with respect to the nozzle, with a chamber 6 which is fed with a pressure fluid through a conduit 7, the latter being preferably elongated according to the direction of the manifold axis (FIG. 5).

Figure 3:
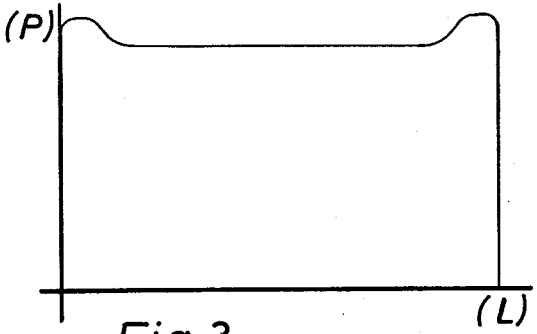
FIG. 3 is a diagram similar to the previous ones, though relating to the case when the nozzle for blowing the air blade is improved according to the present invention.

Within said conduit 7 flows a fluid having a higher pressure than the one fed to the central area of the manifold 1, whereby the diagram of the pressure along the nozzle is shown in FIG. 3. Therefore, the whole 6-7 constitutes an ejector. In order to obtain that said ejector 6-7 may always correspond to the end areas of the strip to be coated, said ejector is integrally slidable together with the associated shutter 5 which may be moved manually or automatically through control means sensing continuously the width of the strip to be coated.

To this end, the ejector cross section, according to what happens for the cross section of shutter 5, matches the inner profile of the two lips 2,3 defining the elongated nozzle 18 fed by manifold 1.

Conduit 7 ends into a sleeve 8 sliding inside a conduit 9 provided at the bottom with the slot 20 for the passage of the elongated conduit 7; however, it is clear that any other system may be used for feeding a pressure fluid into conduit 7 which is movable inside said manifold 1.

For the guide of said ejector 6-7, the forward portion of the wall of chamber 6 rests against the inner surface of the stationary lip 2 on one side and against the inner surface of said lip 3 on the other side, while at the rear it is guided in a groove 10 provided within the thickness of the wall of manifold 1.

It is to be understood that the invention is not limited to the examples shown. It is intended to cover all modifications and equivalents within the scope of the appended claims.

What we claim is:

1. In a coating apparatus, an improved gaseous-knife for doctoring a freshly coated web comprising:

an elongated nozzle formed of two lips inclined toward each other, one lip being substantially perpendicular to the coated web and said lips forming an angle therebetween of about 30° to 80°;

means passing a pressurized gaseous fluid through said lips to form an elongated said knife;

a slideable shutter means disposed within said nozzle, at each end thereof, whereby to adjust the effective length of the elongated slot formed by said lips;

each said shutter configured and operatively associated with one of said lips to form a narrow chamber opening at the outlet of said slot; and means feeding a gaseous fluid through each said chamber at a higher pressure than that of said first recited means;

whereby to effect a composite gaseous-knife having higher pressures at the ends thereof for forming a more uniform coating on said web.

2. A device according to claim 1 wherein said chamber feeding means comprises:

telescopic conduit means disposed in part within said nozzle and parallel to the elongation of said slot;

the outer conduit being fixed and axially slotted;

the inner conduit having a conduit element communicating with it's associated chamber and adapted to extend through said axial slot.

3. A device according to claim 1, wherein said chamber rests against the inner surfaces of the nozzle lips and at its rear is guided by a groove provided within the thickness of the elongated nozzle manifold.

* * * * *